US005393395A

United States Patent [19]

Tanaka et al.

[11] Patent Number: 5,393,395

[45] Date of Patent: Feb. 28, 1995

[54] METHOD OF SURFACE-TREATING A HALF SLIDING BEARING AND APPARATUS FOR SAME

[75] Inventors: Tadashi Tanaka, Konan; Masaaki Sakamoto, Nagoya; Motomu Wada, Owariasahi; Takayoshi Sasaki, Tajimi; Masaki Tanimoto, Gifu, all of Japan

[73] Assignee: Daido Metal Company, Ltd., Nagoya, Japan

[21] Appl. No.: 216,832

[22] Filed: Mar. 24, 1994

Related U.S. Application Data

[60] Division of Ser. No. 75,341, Jun. 11, 1993, which is a continuation of Ser. No. 667,905, Mar. 12, 1991, abandoned.

[30] Foreign Application Priority Data

Mar. 16, 1990 [JP] Japan ..... 2-065691

[51] Int. Cl.[6] ..... C25D 17/00

[52] U.S. Cl. ..... 204/198; 204/202; 204/297 M; 221/212; 118/620; 118/400; 118/423; 118/428

[58] Field of Search ..... 204/297 M, 297 R, 297 W, 204/193, 194, 406, 409, 413, 434, 198, 202, 219, 222; 118/686, 687, 621, 622, 623, 624, 625, 638, 620, 400, 423, 427, 428, 503 B; 221/212, 175, 191, 255, 270, 281, 289

[56] References Cited

U.S. PATENT DOCUMENTS

| | | | |
|---|---|---|---|
| 1,406,968 | 2/1922 | Angus | 221/212 |
| 2,464,883 | 3/1949 | Neumann | 221/212 |
| 2,596,109 | 5/1952 | Abbott | 221/212 |
| 2,657,504 | 11/1953 | Cadman | 221/212 |
| 2,816,790 | 11/1954 | Johnson | 204/297 M |
| 3,141,571 | 7/1964 | Moore | 221/212 |
| 3,156,376 | 2/1963 | Lasting . | |
| 3,172,565 | 3/1963 | Ashworth | 221/212 |
| 3,184,655 | 10/1963 | Brown | 204/297 M |
| 3,226,308 | 12/1965 | Pochapsky et al. | 204/26 |
| 3,276,978 | 10/1966 | Spaulding et al. | 204/45 |
| 3,494,393 | 2/1970 | Casanov | 221/212 |
| 3,852,170 | 12/1974 | Angelini | 204/28 |
| 4,065,378 | 12/1977 | Sauer et al. | 204/297 W |
| 4,318,943 | 3/1982 | Veenstra | 221/212 |
| 4,599,147 | 7/1986 | Thompson | 204/15 |
| 4,731,171 | 3/1988 | Bolte | 204/181.6 |
| 4,787,622 | 11/1988 | Kuaner et al. | 271/225 |
| 4,911,818 | 3/1990 | Kikuchi et al. | 204/198 |
| 5,056,937 | 10/1991 | Tanaka et al. | 384/278 |
| 5,141,626 | 8/1992 | Tanaka et al. | 205/151 |
| 5,152,775 | 10/1992 | Ruppert | 221/270 |
| 5,200,048 | 4/1993 | Tanaka et al. | 204/297 W |

FOREIGN PATENT DOCUMENTS

| | | | |
|---|---|---|---|
| 353332 | 10/1930 | United Kingdom | 204/297 M |
| 582014 | 4/1945 | United Kingdom | 204/297 M |
| 786743 | 11/1957 | United Kingdom . | |
| 830941 | 3/1960 | United Kingdom . | |
| 1030635 | 5/1966 | United Kingdom . | |
| 1308666 | 2/1973 | United Kingdom . | |
| 1326321 | 8/1973 | United Kingdom . | |
| 1400698 | 7/1975 | United Kingdom . | |
| 1478110 | 6/1977 | United Kingdom . | |
| 2210866 | 6/1989 | United Kingdom | 221/191 |
| 8501718 | 4/1985 | WIPO . | |

*Primary Examiner*—W. Gary Jones
*Assistant Examiner*—Mark De Simone
*Attorney, Agent, or Firm*—Browdy and Neimark

[57] ABSTRACT

An apparatus and a method of surface-treating a half sliding bearing, the method comprising the steps of: preparing a tank which accommodates a surface-treatment solution and an anode of an alloy to be applied to the bearings as a surface treatment; successively and one by one introducing the bearings into the surface-treatment solution; performing the surface treatment in such a manner that the surface layer of the alloy is applied to the surface of the bearings by feeding an electricity between a cathode served by the bearing and the anode via the surface-treatment solution while moving, in the surface-treatment solution, the bearings being introduced into the surface-treatment solution in a state in which the bearings is brought into contact with one another; and successively and one by one drawing out the bearings, which have been applied with the surface treatment, from the tank.

19 Claims, 9 Drawing Sheets

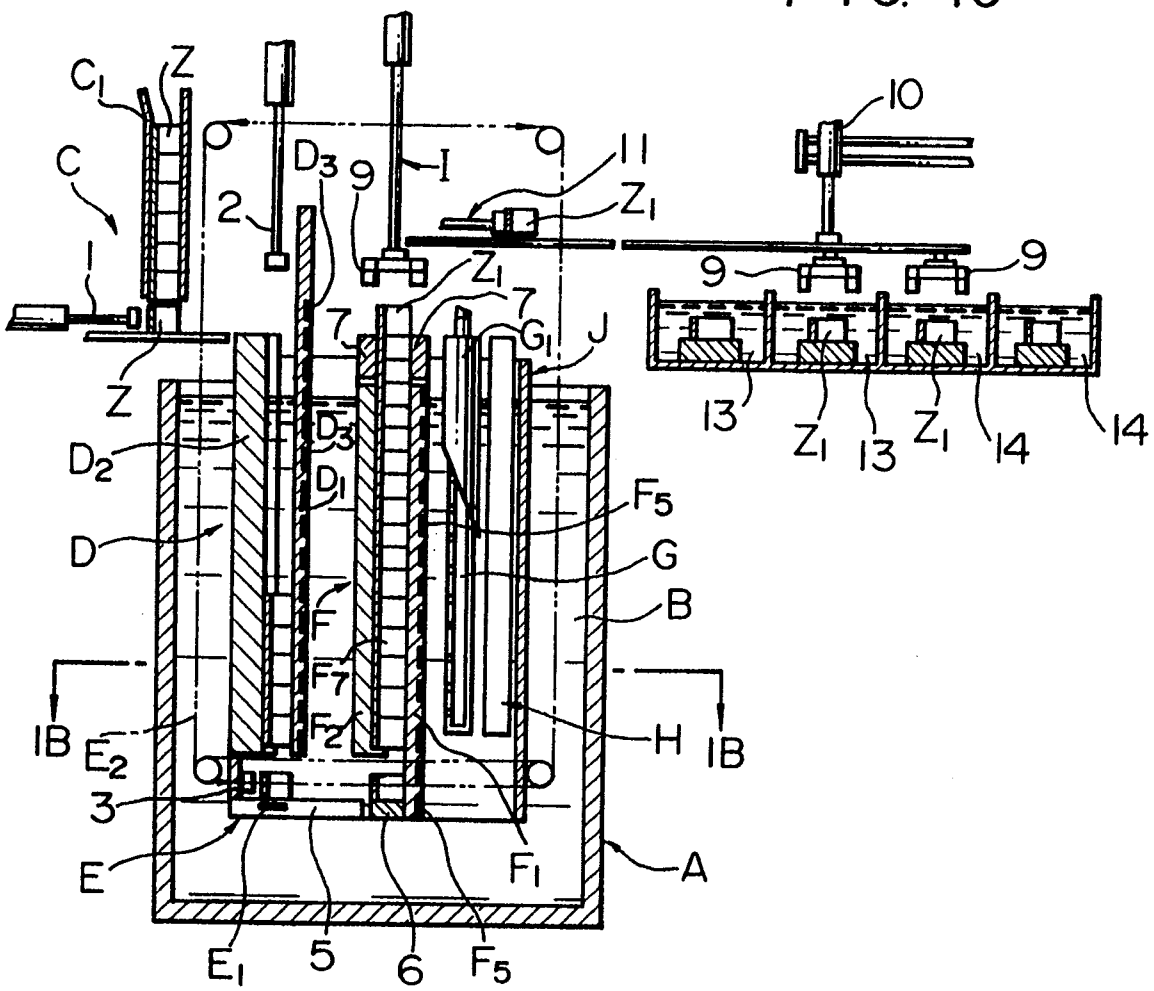
FIG. IA
FIG. IC
A
B
C
C1
D
D1
D2
D3
E
E1
E2
F
F1
F2
F5
F7
G
G1
H
I
J
2
3
5
6
7
9
10
11
13
14
Z
Z1
IB

METHOD OF SURFACE-TREATING A HALF SLIDING BEARING AND APPARATUS FOR SAME

This is a division of co-pending application Ser. No. 08/075,341 filed Jun. 11, 1993, itself a continuation of application Ser. No. 07/667,905, filed Mar. 12, 1991, now abandoned.

BACKGROUND OF THE INVENTION

1. Field of the Invention

The present invention relates to a method and an apparatus for surface-treating the inner surface and/or the outer surface of a half sliding bearing.

2. Related Art

Hitherto, the inner surface of a half sliding bearing is applied with electric plating to form a plating layer of several microns to several tens of microns in thickness in such a manner that an anode bar is disposed in the axial direction along the center line of the inner surfaces of a plurality of half sliding bearings placed in a tank in which a surface-treatment solution is enclosed. In this case, the upper and the lower portions of the half sliding bearing generate the portion in which the desired plating thickness cannot be obtained. Accordingly, members, each of which is so-called a spacer metal or a dummy metal in the form of a half sliding bearing and made of a conductive material, are fastened to the upper and the lower portions of the half sliding bearings. Then, a plating case to which the half sliding bearings have been fastened is treated in a degreasing tank, an electrolytic degreasing tank, an acid dipping tank, a plating tank, a recovery tank, a water rinsing tank, a neutralization tank and a cleaning tank and the like. The treated hale sliding bearings are then removed from the case so that the surface treatment for the half sliding bearings is completed.

However, the conventional technology has encountered the following problems:

(a) The case or a jig to which the plurality of the half sliding bearings have been fastened is dipped into the treatment solution so as to be treated as desired before the half sliding bearings are taken out. However, the quantity of undesirable discharge of the treatment solution is enlarged in proportion to the surface area of the object to be introduced and taken out. The undesirable discharge will enlarge in quantity in proportion to the degree of complication of the structure of the plating case and the like. Therefore, a problem arises in that each of the treatment solution is contaminated due to the rise in the density of the recovered treatment solution, that is, the contamination concentration of the rinsing water. What is even worse, the quality of the plating will deteriorate and problems in terms of the waste water disposal will take place.

(b) In order to uniformly supply electricity to the half sliding bearings, a uniform contact with the power supply portion of the plating case or the jig is necessary. However, there are too many contact portions such as the contact portion between the half sliding bearing and the spacer, that between the spacer and the plating case or the jig and that between the plating case or jig and the hooks of the apparatus. Therefore, the uniform electricity supply is hindered by the total quantity of the contact resistance. As a result, the accuracy in the plating thickness is deteriorated.

(c) Furthermore, the vertical position of the half sliding bearing in the plating case or the jig will cause the change in the electric current distribution characteristics. Hitherto, a method as shown in FIGS. 7A and 7B has been employed in order to reduce the above-described undesirable change in such a manner that spacers 101 each having the same inner diameter as that of the half sliding bearing are disposed in the upper and the lower portions at the time of the electric plating. However, the above-described change has not satisfactorily be prevented. What is even worse, the accuracy in the thickness of the plating will deteriorate due to the inclination of the plating case or the like.

(d) The spacer 101 employed in the manner as described above must be provided for each of the plating cases or the jigs to which a plurality of the half sliding bearings are fastened. Since the spacer 101 is subjected to the plating at each of the plating operations, its surface will be gradually raised and the surface will become too rough. It leads to a fact that the accuracy in the thickness of the plated layer at the portion of the half sliding bearing adjacent to the spacer is deteriorated. Furthermore, another problem arises in that each of the treatment solution is contaminated due to the rise in the concentration of the recovered treatment solution, that is, the contamination density of the rinsing water. What is even worse, problems in terms of the waste water treatment will take place.

(e) According to the conventional method, insoluble sediment adheres to the jig and the quantity of the sediment is enlarged due to a chemical reaction simultaneously with the occurrence of the contamination described in (a) during a period in which the plating case or the jig is dipped in the alkali solution and the acidic solution. Furthermore, since each of the treatment solution is arranged to be used at an individual temperature, the case or the jig must be subjected to a repetition of high temperature and low temperature. As a result, a strain generates in the case or the jig, causing the accuracy in fastening the half sliding bearing to be deteriorated. What is even worse, the accuracy in the thickness of the plating applied to the half sliding bearing is deteriorated.

(f) Since the performance of the engine must be improved and the noise from the same must be reduced in recent years, the half sliding bearing and the surface of the half sliding bearing must be finished extremely precisely. Furthermore, there is a desire for the half sliding bearing to reveal a uniform quality. Therefore, a rigid plating case, a large-size plating apparatus and a large-size waste-water disposal facility are necessary for the above-described conventional methods. Furthermore, a large quantity of water must be supplied. As a result, this, of course, excessively raises the initial cost, the running cost and the cost for the maintenance.

(g) Another problem arises in terms of the manufacturing operation such that too many operations, such as operations of fastening the half sliding bearing to the case, fastening the case to the apparatus, removing the same from the apparatus and drawing out the half sliding bearing from the case, must be repeated. Therefore, an excessively large cost is necessary to complete the above-described repetitive operations if the above-described operations are performed by humans or automatic apparatuses. Therefore, the manufacturing cost has not been reduced.

SUMMARY OF THE INVENTION

Accordingly, an object of the present invention is to overcome the above-described problems experienced with the conventional technology.

In order to achieve the above-described object, an aspect of the present invention lies in a method of surface-treating a half sliding bearing comprising the steps of: preparing a tank which accommodates a surface-treatment solution and an anode of an alloy to be applied to the half sliding bearings as a surface treatment; introducing successively and one by one the half sliding bearings into the surface-treatment solution; performing the surface treatment in such a manner that the surface layer of the alloy is applied to the surface of the half sliding bearings by feeding an electricity between a cathode which is served by the half sliding bearing and the anode via the surface-treatment solution while moving, in the surface-treatment solution, the half sliding bearings being introduced into the surface-treatment solution in a state in which the half sliding bearings is brought into contact with one another; and drawing out successively and one by one the half sliding bearings, which have been applied with the surface treatment, from the tank.

Another aspect of the present invention lies in an apparatus for surface treating a half sliding bearing comprising: a tank for accommodating a surface-treatment solution; a surface layer forming device including a slide plate device $F_1$, $F_2$ disposed in the tank and acting for movably arranging a plurality of the half sliding bearings while maintaining a state of contact of the plurality of half sliding bearings and a power supply device which comes in electrically contact with the half sliding bearings of the plurality of half sliding bearings disposed outside the surface-treatment solution; a surface-treatment solution stirring pipe disposed away from the surface layer forming device; and an electrode disposed away from the surface-treatment solution stirring pipe.

According to the present invention, a plurality of half sliding bearings, which are the subjects of the surface treatment, are successively and one by one introduced into the surface-treatment solution and applied with the surface treatment by and electricity supplied thereto during their movement in the surface-treatment solution while being brought into contact with one another. Therefore, the half sliding bearings can be successively applied with the surface treatment. As a result, an excellent working efficiency can be realized. Furthermore, since the half sliding bearings pass through the same surface treatment route in the surface-treatment solution, all of the half sliding bearings are applied to the surface treatment under the same conditions. Therefore, the half bearings can be applied with the surface treatment of the same quality.

Other and further objects, features and advantages of the invention will be appear more fully from the following description.

BRIEF DESCRIPTION OF THE DRAWINGS

FIGS. 1A, 1B and 1C are partial and schematic cross sectional views which respectively illustrate a first embodiment of a surface treatment technology according to the present invention;

DESCRIPTION OF THE PREFERRED EMBODIMENTS

First Embodiment

Figure 1B:
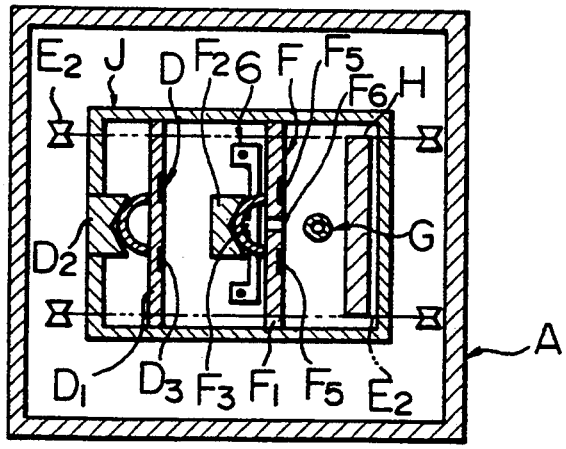
Figure 1D:
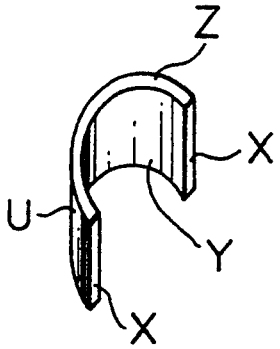
FIG. 1D is a perspective view which illustrates a half sliding bearing to which the surface treatment is applied.

FIGS. 1A, 1B and 1C respectively illustrate a first embodiment of the present invention. Referring to FIGS. 1A, 1B and 1C, an example of the surface treatment is illustrated in which an inner surface Y of a half sliding bearing Z shown in FIG. 1D is applied with Ni-plating. The half sliding bearing Z has an inner surface formed by coupling a steel base the thickness of which is 1.2 mm and a copper lead bearing alloy sintered layer (25 wt % Pb, 0.5 wt % Sn and the balance Cu), the half sliding bearing Z having a size arranged in such a manner that the outer diameter is 63 mm, the inner diameter is 60 mm, the thickness is 1.5 mm and the width is 26.5 mm.

Referring to the drawings, symbol A represents a tank of 50 cm deep and in the form of 60 cm×30 cm rectangular cross sectional shape, the tank A enclosing a known Watts electrolytic Ni plating solution B the temperature of which is 40° to 60° C. and pH-value of which is 2.0 to 4.0. Symbol C represents a device for introducing the half sliding bearing Z and disposed above the tank A. The half sliding bearing introducing device C comprises a hopper $C_1$ which holds the half sliding bearing Z in such a manner that the half sliding bearings Z can be freely dropped. The half sliding bearing introducing device C further comprises a piston cylinder device 1 for successively moving the half sliding bearings Z supplied from the hopper $C_1$. The hopper $C_1$ is arranged to be in the form of a cylinder elongating in the vertical direction. However, another structure may be employed in which the hopper is replaced by a belt conveyer device so as to supply the half sliding bearings Z to the piston cylinder device 1. Symbol D represents a half sliding bearing dipping device for successively moving the half sliding bearings Z, each of which has been moved to a position above the surface-treatment solution accommodating tank A, to the lower portion of the surface-treatment solution accommodating tank A, the half sliding bearing dipping device D being secured to an outer frame J. The half sliding bearing dipping device D comprises a holding device for movably holding each of the half sliding bearings Z toward the lower portion of the surface-treatment solution accommodating tank A. Furthermore, the half sliding bearing dipping device D comprises a piston cylinder device 2 for forcibly pushing the half sliding bearing Z held by the holding device toward the lower portion of the surface-treatment solution accommodating tank A. The holding device comprises a plate member $D_1$ having a length of 51 cm and positioned in contact with an end portion X of the half sliding bearing Z and extending in the vertical direction. The holding device further comprises a rod member $D_2$ having a substantially V-shaped surface which comes in contact with a circular arc portion U of the half sliding bearing Z, the rod member $D_2$ performing an assist role for holding the half sliding bearing Z when the half sliding bearing Z is moved to the lower portion of the surface-treatment solution accommodating tank A due to the action of the piston cylinder device 2. The rod member $D_2$ is positioned away from the plate member $D_1$ in the horizontal direction. The plate member $D_1$ includes a magnet $D_3$ embedded in the lengthwise direction of the plate member $D_1$ and at a position corresponding to the position at which the end portion X of the half sliding bearing Z comes in contact, the magnet $D_3$ being positioned on the side opposing the surface of the half sliding bearing Z. The magnet $D_3$ reveals magnetic force which is capable of preventing the free dropping of the half sliding bearing Z but which permits the same to move toward the lower portion of the surface-treatment solution accommodating tank A along the plate member $D_1$ due to the action of the piston cylinder device 2. It is preferable that five half sliding bearings Z be held by that half sliding bearing dipping device D in a direction from a position of the lower portion of the plate member $D_1$ to the middle position of the same while being positioned in contact with one another, as shown in FIG. 1A.

Figure 3:
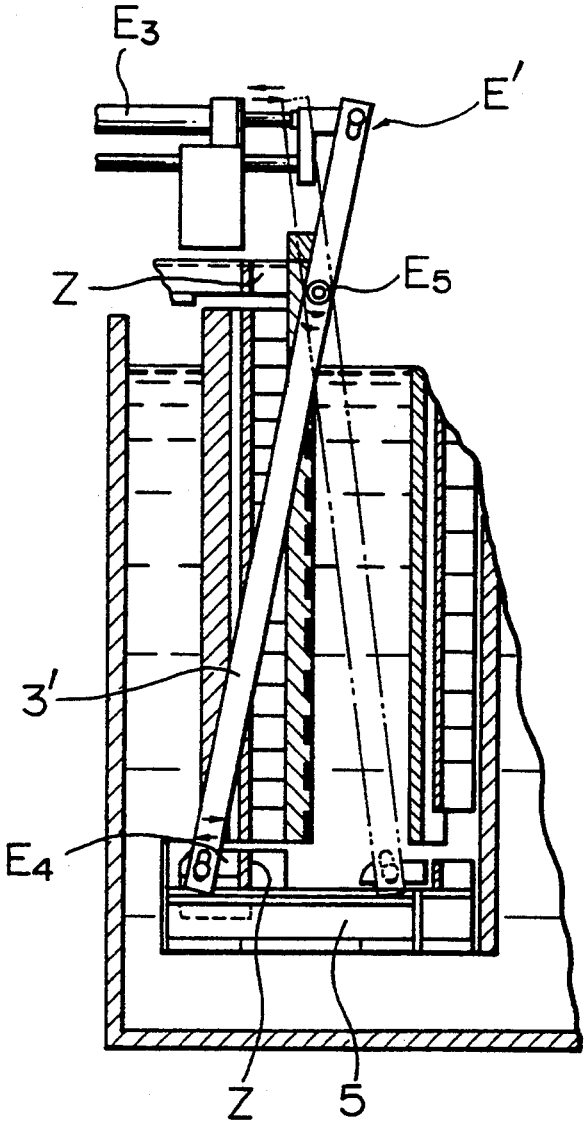
FIG. 3 is a partial cross sectional view which illustrates a rod type device for horizontally conveying the half sliding bearing.

Symbol E represents a horizontal conveyance device for horizontally moving the half sliding bearing Z which has been moved in the surface-treatment solution toward the lower portion of the surface-treatment solution accommodating tank by the half sliding bearing dipping device D, the horizontal conveyance device E being secured to the outer frame J. The horizontal conveyance device E comprises a holding plate member 5 for holding the half sliding bearing Z in such a manner that the half sliding bearing Z is able to move horizontally, the holding plate member 5 being made of an insulating material. The horizontal conveyance device E further comprises pushers 3 for horizontally moving the half sliding bearing Z. The holding plate member 5 includes a magnet $E_1$ embedded therein, the magnet $E_1$ stably and movably holding the half sliding bearing Z. The pushers 3 are connected to each other by a wire (or a belt) $E_2$ which is moved by a piston cylinder device (omitted from illustration) disposed above the surface-treatment solution accommodating tank A so that the pusher 3 and the half sliding bearing Z, which is positioned in contact with the pusher 3, are horizontally moved to the right when viewed in FIG. 1A. Another horizontal conveyance device $E_1$ which is provided with a rod 3' shown in FIG. 3 as an alternative to the pusher 3 may be employed. The upper end portion of the rod 3' is connected to a piston cylinder device $E_3$. Furthermore, a fastening member $E_4$ having a substantially V-shaped contact surface for pushing and horizontally moving the half sliding bearing Z is disposed at the lower end portion of the rod 3'. The rod 3' has a support shaft $E_5$ between two lengthwise end portions thereof so that the rod 3' is supported in such a manner that it is able to swing freely.

Figure 4:
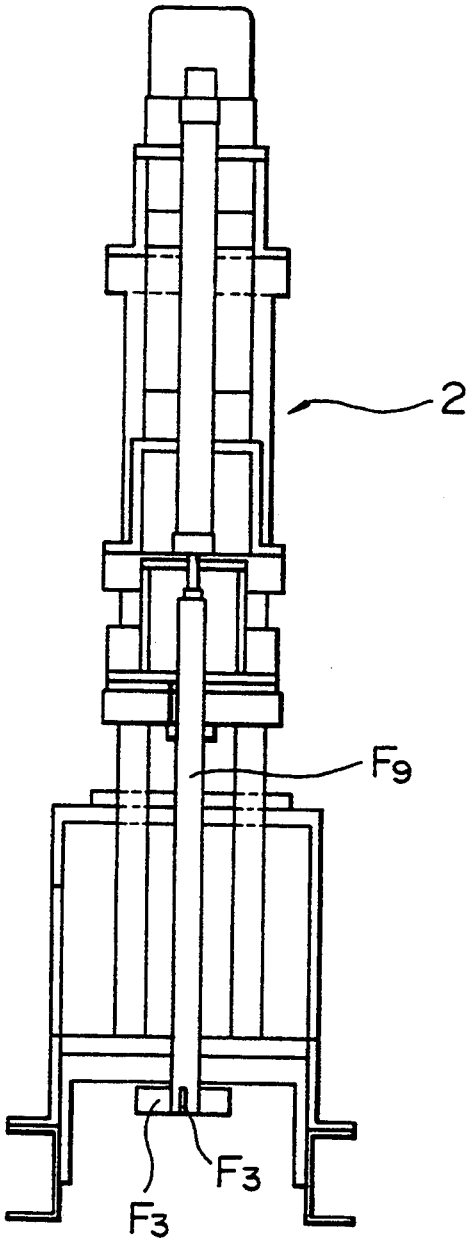
FIG. 4 is a front elevational view which illustrates a device for pushing half sliding bearings in the vertical direction.
Figure 5:
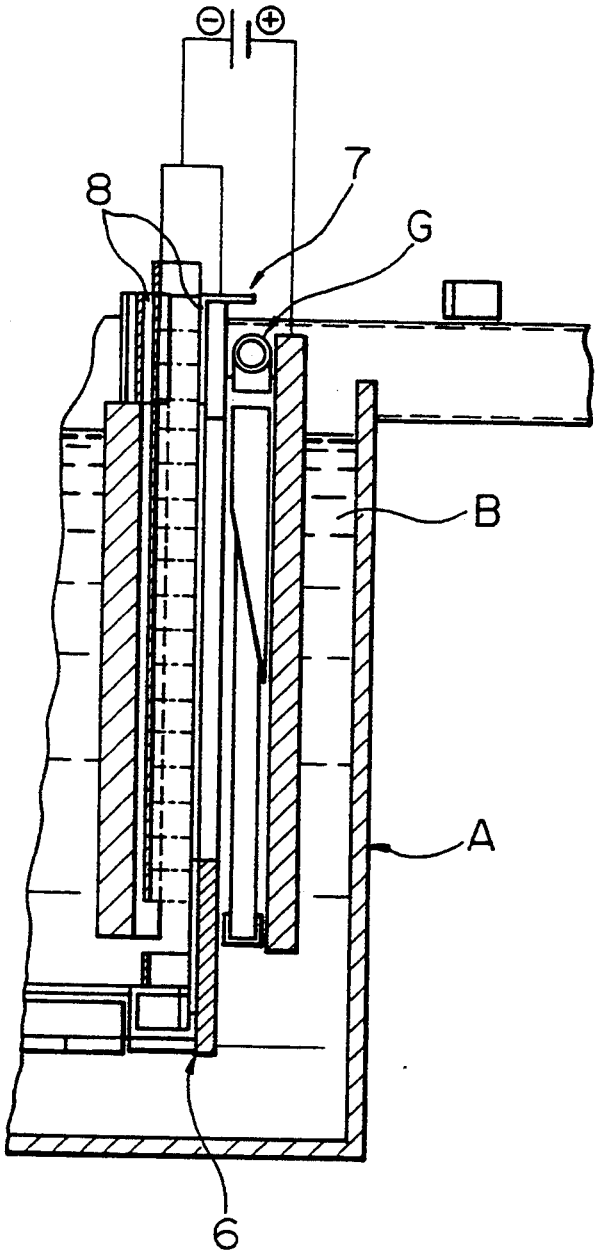
FIG. 5 is a partial cross sectional view which illustrates a slide plate device and a power supply device.

Symbol F represents a surface layer forming device for upwardly moving the half sliding bearing Z, which has been conveyed to a predetermined position in the lower portion of the surface-treatment solution accommodating tank A by the horizontal conveyance device E or E', to the upper portion of the tank A. The surface layer forming device F further acts to effect the surface treatment, that is, the Ni-plating, to be applied to the surface of the half sliding bearing Z which is dipped in the Watts nickel plating solution during the above-described movement of the half sliding bearing Z by an electricity supplied while arranging the half sliding bearing Z to act as a cathode. The surface layer forming device F is secured to the outer frame J. The surface layer forming device F comprises a lifting device 6 for lifting the half sliding bearing Z toward the upper portion of the tank A. The surface layer forming device F further comprises a slide plate device $F_1$ for holding the half sliding bearings Z, which are being lifted, in such a manner that they are positioned in contact with each other and they are able to upwards move, the slide plate device $F_1$ being arranged to have a magnet embedded therein and to be in the form of a plate. The surface layer forming device F further comprises a rod member $F_1$ disposed away from the slide plate device $F_1$ by a distance determined to correspond to the size of the half sliding bearing Z. The rod member $F_2$ acts to prevent a back sides U of the bearings from being applied with the surface treatment when 14 half sliding bearings Z are moved toward the upper portion of the tank A while being positioned in contact with one another. The rod member $F_2$ further performs an assist role to hold the half sliding bearings Z. The surface layer forming device F further comprises a power supply device 7 disposed at the top end portion of the slide plate device $F_1$ above the surface-treatment solution, the power supply device 7 having a conductive member arranged to come in contact with the half sliding bearing Z, which has been moved outside the surface-treatment solution so as to cause an electric current to be supplied to the half sliding bearings Z which are being submerged in the surface-treatment solution. As shown in FIG. 4, the pushing device 2 comprises a piston cylinder device $F_9$ and a lifting contact portion $F_3$ connected to the piston cylinder device $F_9$ and arranged to come in contact with the lower portion of the half sliding bearing Z so as to lift it. The slide plate device $F_1$ is similarly structured to the plate member $D_1$, the slide plate device $F_1$ being made of an insulating material in which magnets $F_5$ are embedded to its portions which correspond to the contact portions with the two end portions of the half sliding-bearing Z. Furthermore, the slide plate device $F_1$ has, at a position which corresponds to the inner portion Y of the circular arc portion of the half sliding bearing Z, a through hole $F_6$ the width of which is 12 mm and the length of which is 330 mm. The through hole $F_6$ is formed from the position adjacent to the top end portion of the slide plate device $F_1$ to the position adjacent to the bottom portion of the same. The rod member $F_2$ is structured similarly to $D_2$ and arranged to have a V-shaped groove which is capable of coming in contact with the circular arch shaped back side U of the half sliding bearing Z. The rod member $F_2$ is, similarly to the slide plate device $F_1$, formed from the lower portion of the tank A to the position above the tank A. Therefore, rod member $F_2$ substantially protects the back side U of the half sliding bearing Z from application of the surface treatment when the half sliding bearing Z is upwardly moved. Furthermore, the rod member $F_2$ performs an assist role to cause the magnet $F_5$ of the slide plate device $F_1$ to hold the half sliding bearing Z in such a manner that the half sliding bearing Z can be upwardly moved. The power supply device 7 comprises, as shown in FIG. 5, a conductive member 8 arranged to be in the form of a shape capable of coming in contact with the end portion X and the circular arc portion U of the half sliding bearing Z which has been drawn out from the surface-treatment solution. The conductive member 8 is connected to the negative side of a power supply device (omitted from illustration).

Figure 6:
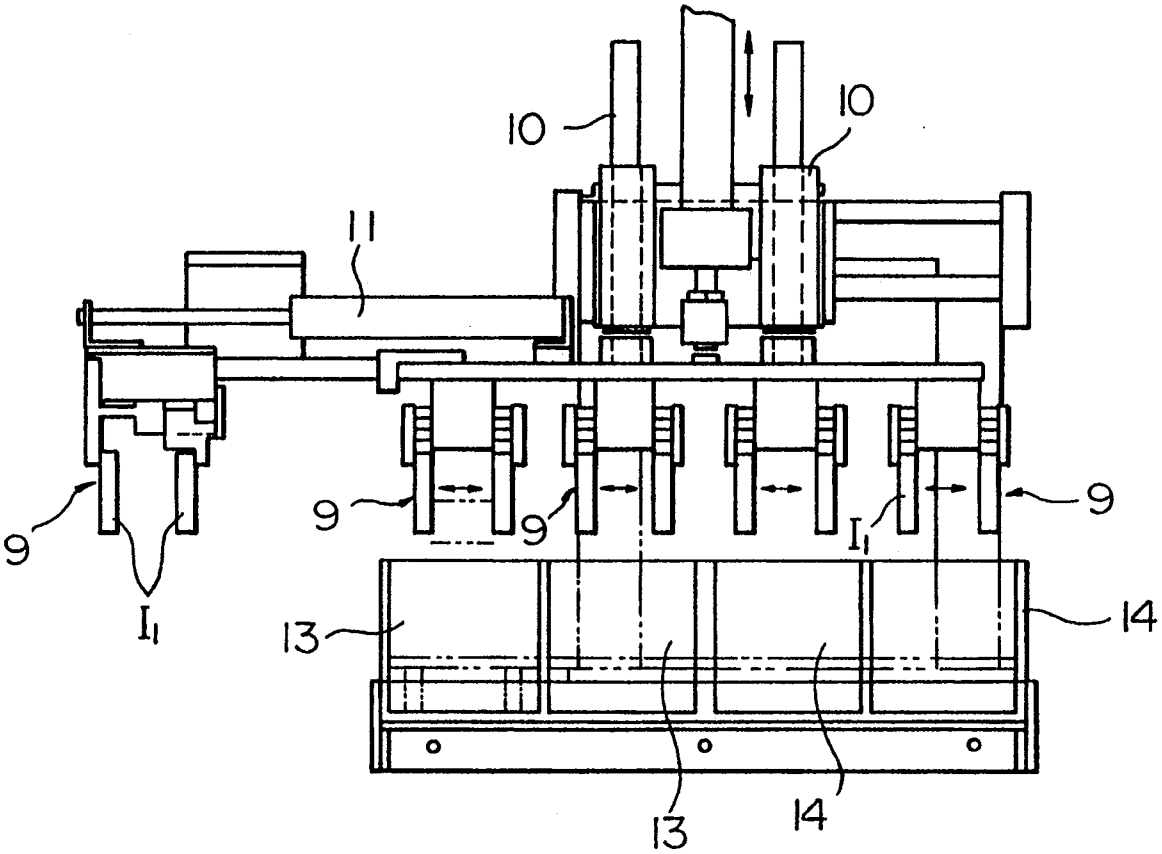
FIG. 6 is a schematic view which illustrates a lifting and conveyance device.

Symbol G represents a surface-treatment solution stirring pipe disposed at a position corresponding to the through hole $F_6$ and arranged to jet the surface-treatment solution that is, the Watts Ni-plating solution toward the through hole $F_6$ at a pressure level of 0.2 kgf/cm$^2$. The surface-treatment solution stirring pipe G is arranged to be in the form of a cylindrical pipe the outer diameter of which is 20 mm and the inner diameter of which is 18 mm. The surface-treatment solution stirring pipe G has 10 openings the outer diameter of each of which is 2 mm and which are disposed at a pitch of 30 mm so as to correspond to the through hole $F_6$. A cover pipe $G_1$ is concentrically fitted to cover the upper portion of the stirring pipe G. The cover pipe $G_1$ is arranged to be rotated so as to adjust the effective working length of the surface-treatment solution stirring pipe G when the condition for applying the surface treatment is changed and the solution level in the tank A is therefore changed. Symbol H represents an electrode portion made of a nickel plate the width of which is 126 mm, the height of which is 550 mm and the thickness of which is 5.0 mm, the electrode portion serving as an anode working in association with the surface-treatment solution when the surface of the half sliding bearing is applied with the surface treatment, that is, the Ni-plating. Symbol I represents a lifting and conveyance device for drawing out the half sliding bearing $Z_1$ to which the surface treatment (plating process) has been applied so as to convey it to a recovery chamber 13 and a water washing tank 14 disposed away from the tank A. The lifting and conveyance device I comprises a chucking device 9 (see FIGS. 1A, 1C, 2A, 2C and 6) for chucking the half sliding bearing $Z_1$ and a piston cylinder device for vertically moving the chucking device 9. The lifting and conveyance device I further comprises a piston cylinder guide device 11 for horizontally moving the drawn half sliding bearing $Z_1$ so as to place it above the recovery tank 13 and above the water washing device 14, whereby the processes are performed. The lifting and conveyance device I further comprises a piston cylinder device 10 (see FIGS. 1C, 2C and 6) for introducing the half sliding bearing $Z_1$, which has been moved to a position confronting the recovery tank 13 or the water washing tank 14 by the piston cylinder guide device 11, into the recovery tank 13 or the water washing tank 14, the piston cylinder device 10 then moving the half sliding bearing $Z_1$ to the next process after the above-described processes have been completed. The chucking device 9 is a known chucking device having a pair of arms $I_1$ which are operated by compressed air. The recovery tank 13 is filled with a dilution solution of the surface-treatment solution for removing a substantial part of the surface-treatment solution adhered to the surface of the half sliding bearing $Z_1$. In accordance with an increase in the number of the half sliding bearings $Z_1$ which have been subjected to the processes, the density of the dilution solution is raised. Therefore, the dilution solution the concentration of which has been raised over a certain concentration is returned to the bath A after its concentration has been raised. The water washing tank 14 removes a residual surface-treatment solution of a small quantity finally left on the surface of the half sliding bearing $Z_1$ after the surface-treatment solution has been removed by the recovery tank 13.

Then, an operation of the Ni-plating process according to this embodiment of the present invention will now be described.

First, 20 pieces of half sliding bearings or the spacers having the same shape as that of the half sliding bearing and made of the same material as that of the half sliding bearing were supplied to the half sliding bearing dipping device D through the hopper $C_1$ by the piston cylinder device 1. Then, the half sliding bearings Z to become products were successively supplied through the hopper $C_1$ until a stable state was realized in the half sliding bearing dipping device D. The half sliding bearings Z were then moved from the half sliding bearing dipping device D to the horizontal conveyance device E at a speed of about 15 pieces/minute. Then, the half sliding bearings Z were sent to the half sliding bearing surface treatment device F by the pusher before they were upwards moved by the lifting device 6 by about 70 mm corresponding to the stroke of the lifting device 6. The half sliding bearings Z were then successively held by the slide plate device $F_1$ while being positioned in contact with one another so as to be moved upwards at a speed of 0.4 m/minute. When the leading half sliding bearing Z or the spacer reached and was brought into contact with the power supply device 7, the half sliding bearing Z or the spacer, which was being upwardly moved, served as a cathode so that an electric current was supplied at a current density of about 12 A/dm$^2$ via the power supply portion 7. Simultaneously, the surface-treatment solution was jetted through the surface-treatment solution stirring pipe G under a pressure level of 0.2 kgf/cm$^2$ or less. Thus, the Ni-plating operation as the surface treatment was started. After the Ni-plating had been applied to 12 half sliding bearings or the spacers, the Ni-plating conditions were stabled (that is, the first group of the half sliding bearings or the spacer was not applied to the Ni-plating of a predetermined quantity) so that an Ni-plated layer the average thickness of which was 1.52 $\mu$m was formed on the inner surface Y of each of the half sliding bearings Z. The characteristics of the Ni-plated layer thus formed are shown in Table 1. The half sliding bearings $Z_1$ were, after they were applied with the Ni-plating, lifted by the lifting and conveyance device I so as to be successively conveyed to the recovery tank 13 and the water washing tank 14. As a result, a substantial part of the quantity of the Watts Ni-plating solution was dripped into the tank A at the time of the lifting operation. The residual Ni-plating solution adhered to the half sliding bearing Z was recovered when the half sliding bearing Z was dipped in the dilution solution of the Watts Ni-plating solution. Then, the half sliding bearings Z were washed with water in the water washing tank 14. Thus, the Ni-plating operation was completed. It is preferable that the dilution solution in the recovery tank be sent to the tank A after its concentration has been raised to a predetermined concentration so as to again use it.

At the time of finishing the above-described surface treatment operation, 20 spacers were, similarly to the state in which the process was started, supplied to the surface treatment process in the half sliding bearing surface treatment device F via the hopper $C_1$, the half sliding bearing dipping device D and the horizontal conveyance device E. Then, they were drawn out from the solution B so as to be subjected to the processes similarly to the stable state. In this case, the final five spacers positioned in the half sliding bearing dipping device D were successively conveyed to the horizontal conveyance device E by successively enlarging the pushing-down stroke of the piston cylinder device 2 by a degree corresponding to one half sliding bearing. In the half sliding bearing surface treatment device F, the lifting stroke of the lifting device 6 was successively enlarged by a degree corresponding to one half sliding bearing when the final spacer was positioned at the lifting device 6. As a result, all of the spacers were moved outside the tank A. As an alternative to the above-described process in which the stroke was enlarged so as to treat the final spacer, another structure may be employed in which the piston cylinder device is successively and downwards moved at a pitch corresponding to one half sliding bearing while making the stroke to be constant. Furthermore, the lifting device 6 may be successively and upwards moved so as to treat the final spacer.

Figure 7A:
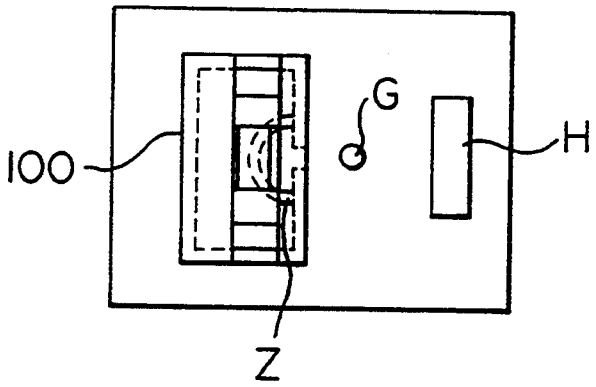
FIG. 7A PRIOR ART
FIGS. 7A and 7B are schematic views which illustrate a conventional technology for surface treating the half sliding bearing.
Figure 7B:
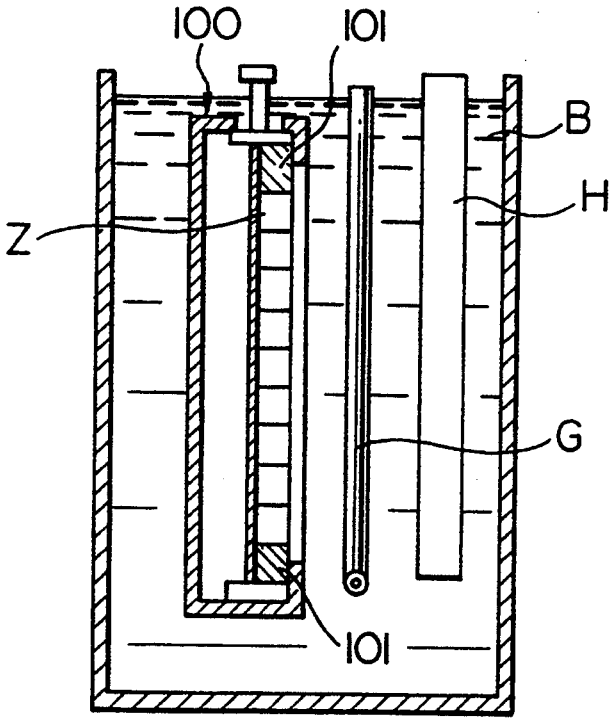
FIG. 7B PRIOR ART

In order to make a comparison with the half sliding bearings subjected to the Ni-plating as the surface treatment according to the present invention, another conventional Ni-plating operation was performed in such a manner that a cassette was formed by coupling, via spacers, a plating case 100 shown in FIGS. 7A and 7B and half sliding bearings. Then, the thus arranged cassette was subjected to the Ni-plating operation while using the same Watts Ni-plating solution and arranging the same plating conditions. The characteristics of the thus formed Ni-plated layer are shown in Table 1.

As can be clearly seen from Table 1, the Ni-plated layer according to the present invention displayed superior characteristics to those of the comparative Ni-plated layer in terms of the accuracy in the thickness, roughness, the adhesion force and the efficiency of the operation of the cathode.

Although the description is made about a case referring to FIGS. 1A to 1C in which the Ni-plated layer is formed, the present invention can, of course, be applied to surface treatment operations for forming another metal or alloy metal layer.

Second Embodiment

Figures 2A, 2B, 2C:
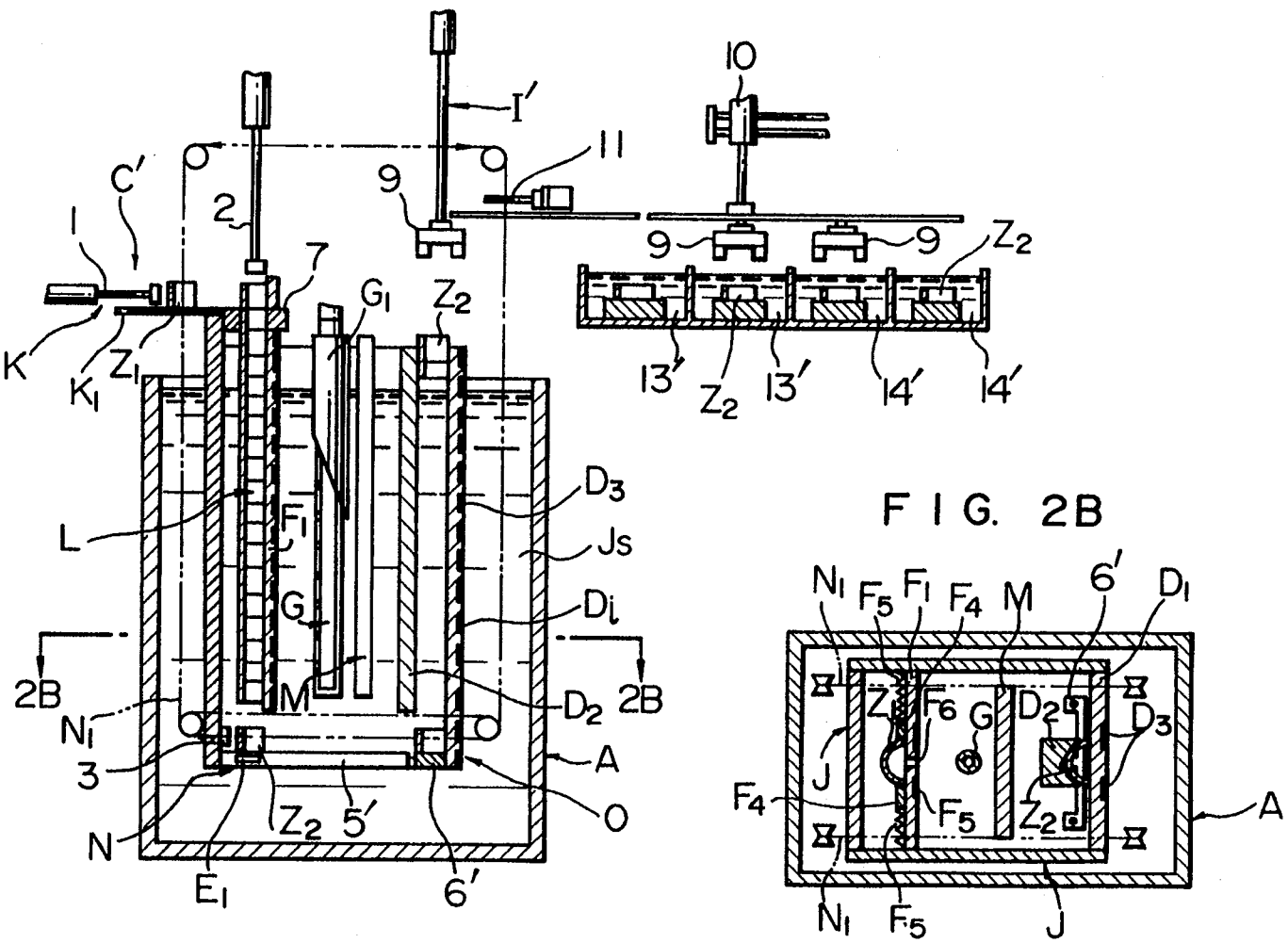
FIGS. 2A, 2B and 2C are partial and schematic cross sectional views which respectively illustrate a second embodiment of the present invention.

FIGS. 2A, 2B and 2C illustrate a second embodiment of the present invention. According to the second embodiment, two types of lead alloy electrolyte plated layers are formed on the surface of the half baring $Z_1$ to which the Ni-plated layer had been applied according to the first embodiment 1. Referring to the drawings, the same elements as those according to the first embodiment are given the same reference numerals. Symbol A represents known fluororate solution for lead alloy plating which respectively enclose an alloy plating solution J composed of 10 wt % Sn and Pb as the balance and an alloy plating solution J composed of 10 wt % Sn, 2 wt % Cu and Pb as the balance. The tank A is arranged so as to have a 60 cm×30 cm rectangular cross section and a depth of 90 cm. According to this embodiment, two tank A are prepared so as to enclose two types of the plating solution $J_s$. Symbol K represents a half sliding bearing introduction device C' disposed above the tank A and comprising a piston cylinder device 1 for successively moving the half sliding bearings $Z_1$ above the tank A. The half sliding bearing introduction device C' further comprises a frame $K_1$ for holding the half sliding bearing $Z_1$. Symbol L represents a surface layer forming device for moving and dipping the half sliding bearing $Z_1$, which has been conveyed by the half sliding bearing introduction device K, into the plating solution J enclosed in the tank A. The surface layer forming device L is further arranged to apply, during the movement of the half sliding bearing, the surface treatment, that is, the Pb alloy plating to the surface of the half sliding bearing which is being dipped in the lead alloy plating Solution $J_s$ by passing an electric current while arranging the half sliding bearing to be a cathode. The surface layer forming device L is secured to an outer frame J. The surface layer forming device L comprises a power supply device 7 which is made of a conductive material so as to establish an electric connection between the half sliding bearing $Z_1$ and an external power source (omitted from illustration). The surface layer forming device L further comprises a piston cylinder device 2 for downwards moving the half sliding bearing $Z_1$ toward the lower portion of the tank A. The surface layer forming device L further comprises a slide plate device $F_1$ for holding the half baring $Z_1$ in such a manner that the half sliding bearing $Z_1$ cannot be freely dropped but the same is able to move toward the lower portion of the tank A. The slide plate device $F_1$ further acts to cause the Pb alloy plating to be applied to the surface of the half sliding bearing $Z_1$, the slide plate device $F_1$ being arranged to have the same structure as that according to the first embodiment. The slide plate device $F_1$ comprises a half sliding bearing holding device performing an assist role to hold the half sliding bearing $Z_1$. The half sliding bearing holding device comprises an elongated member $F_4$ which comes in contact with the outer periphery of the half sliding bearing $Z_1$ and a spring member $F_5$ for urging the elongated member $F_4$ against the half sliding bearing $Z_1$. Symbol G represents a stirring pipe having the same structure as that according to the first embodiment, the stirring pipe G having, similarly to the first embodiment, a cover pipe $G_1$. Symbol M represents an anode plate the width of which is 126 mm, the length of which is 550 mm and the thickness of which is 20.0 mm and which is made of a material composed of 10 wt % Sn and Pb as the balance. The anode plate acts to supply the Pb alloy composition to the inner surface of the half sliding bearing $Z_1$. Symbol N represents a horizontal conveyance device for receiving the half sliding bearing $Z_2$ to which the surface treatment has been applied by the half sliding bearing surface treatment device and horizontally conveying it in the lower portion of tank A. Similarly to the horizontal conveyance device according to the first embodiment except for the structure arranged in such a manner that the conveyance distance is slightly longer, the horizontal conveyance device N according to this embodiment comprises a pusher 3, a wire or a belt $N_1$ for moving the pusher 3, a plate member 5' and a magnet $E_1$ embedded in the plate member 5'. As an alternative to the device N, a device E' shown in FIG. 3 may be employed. Symbol O represents a half sliding bearing lifting device for receiving the half sliding bearing $Z_2$, which has been moved by the horizontal conveyance device N, so as to lift it to the position above the tank A, the half sliding bearing being lifting device O being secured to the outer frame J. The half sliding bearing lifting device O comprises a lifting frame 6' which receives the half sliding bearing $Z_2$ sent by the horizontal conveyance device. The half sliding bearing lifting device O further comprises a lifting device 6' for lifting the half sliding bearing $Z_2$, which has been placed on the lifting frame 6', to a position above the tank A, the lifting device 6' being arranged similarly to that according to the first embodiment. Furthermore, the half sliding bearing lifting device O comprises a plate member $D_1$ the length of which is 91 cm and a rod member $D_2$ for holding the half sliding bearing $Z_2$, which has been lifted by the lifting device 6', the half sliding bearing $Z_2$ being held in such a manner that can be upwardly moved. However, the rod member $D_2$ may be omitted from the structure. Symbol I' represents a lifting and conveyance device for conveying the half sliding bearing $Z_2$, which has been lifted to the position above the tank A, to a recovery tank 13' and a water rinsing tank 14' which are disposed away from the tank A. The above-described elements are respectively arranged similarly to the lifting and conveyance device I, the recovery tank 13 and the water washing chamber 14 according to the first embodiment.

Then, a Pb alloy plating operation as the surface treatment according to the second embodiment will now be described. The half sliding bearings or the spacers to which the surface treatment according to the first embodiment has been applied are conveyed to the half sliding bearing surface treatment device L by the piston cylinder device 1. Then, they are downwards moved by the piston cylinder device 2 until they come in contact with the power supply portion 7. Then, the half sliding bearings or the spacers are brought to the power supplied state since they are dipped into the Pb alloy plating solution while maintaining a contact state between any one of the half sliding bearings or the spacers and the power supply portion 7. As a result, the Pb alloy plating operation is started. When the leading half sliding bearing or the spacer had reached the lower end portion of the surface treatment device, the stable state of the Pb alloy plating was realized. Thus, the half sliding bearings, which became the products, were applied to the Pb alloy plating at a speed of 15 pieces/minute (that is, 0.4 m/minute). Then, the half sliding bearings $Z_2$ were conveyed to the lifting device 6' by the horizontal conveyance device N so that the half sliding bearings $Z_2$ were conveyed to the position above the surface-treatment solution by a degree corresponding to the lifting stroke arranged for the lifting device 6' by the action of the lifting device 6'. Then, the half sliding bearings $Z_2$ were subjected to the similar processes according to the first embodiment. The above-described lifting stroke may be divided into two stages. The temperature of the plating solution in the tank A was 25° to 35° and the pressure of the plating solution jetted from the stirring pipe G was 0.2 kgf/cm$^2$, the current density of the cathode was 30 A/dm$^2$, the average thickness of the alloy plating layer composed of 10 wt % Sn and Pb as the balance was 19.1 μm and the average thickness of the alloy plated layer composed of 8 wt % Sn, 2 wt % Cu and Pb as the balance was 19.6 μm. The characteristics of the thus formed plated layer are shown in Table 1.

In order to make a comparison with the half sliding bearing applied with the Pb alloy plating as the surface treatment according to the present invention, conventional cassette formed by coupling the case 100 shown in FIGS. 7A and 7B and the half sliding bearings $Z_1$ via the spacers 101 was subjected to the Pb plating while using the two Pb alloy plating solution similarly to the embodiment 2 except for a current density of 6 A/dm$^2$ (a plating solution composed of 10 wt % Sn and Pb as the balance) and 3 A/dm$^2$ (a plating solution composed of 8 wt % Sn, 2 wt % Cu and Pb as the balance). The characteristics of the Pb alloy plated layer were evaluated. The results are shown in Table 1.

As can be clearly seen from. Table 1, the Pb alloy plated layer according to the present invention displayed superior characteristics in terms of the accuracy in the plating thickness, the roughness, the adhesion force and the efficiency of the operation of the cathode to the Pb alloy plated layer according to the comparative example.

TABLE 1

| Method and Apparatus | Type of Plating | Thickness of Plating (μm) | *Standard Deviation (μm) | Surface Roughness (Rmax) | **Adhesive Force (kgf/cm$^2$) | ***Efficiency of Cathode (%) |
|---|---|---|---|---|---|---|
| Conventional Method and Apparatus (Comparative Example) | Ni | 1.45 | 0.6 | 1.7 | 7.5 | 79.7 |
| | Ni + [90 wt % Pb − 10 wt % Sn] | 17.9 | 1.5 | 3.5 | 7.9 | 89.5 |
| | Ni + [88 wt % Pb − 10 wt % Sn − 2 wt % Cu] | 17.6 | 1.3 | 2.2 | 8.1 | 88.0 |
| Method and Apparatus According to the Present Invention | Ni | 1.52 | 0.5 | 1.5 | 8.4 | 90.7 |
| | Ni + [90 wt % Pb − 10 wt % Sn] | 19.1 | 0.7 | 2.1 | 8.8 | 95.5 |
| | Ni + [88 wt % Pb − 10 wt % Sn − 2 wt % Cu] | 19.6 | 0.6 | 1.4 | 8.7 | 98.0 |

*the standard deviation of the thickness of half sliding bearing before no plating was applied was 0.45 μm, the surface roughness was 1.1 μm or less, the aiming thickness of the Ni-plating was 1.50 μm and the aiming thickness of the Pb alloy plating was 20.0 μm.
**the thickness of the nickel plating and the lead alloy plating was measured by electrolytic Kocool film thickness measuring apparatus, and the adhesive force was measured in accordance with a method of measuring the adhesive force of a multi-layered material disclosed in U.S. Pat. No. 4,501,154.
***the efficiency of the cathode was calculated by an equation expressed by (actual deposition thickness)/(theorical deposition thickness) × 100%

Embodiment 3

Figure 8:
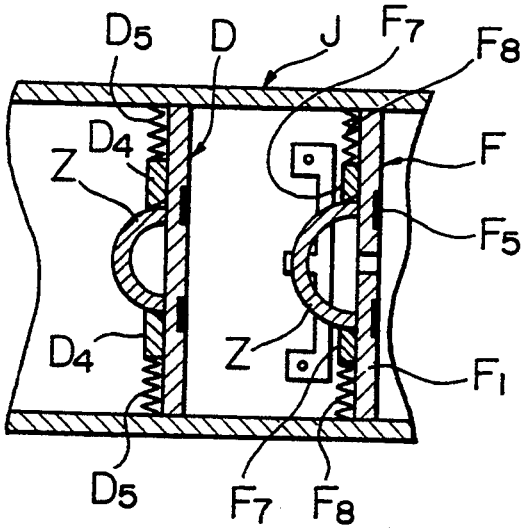
FIGS. 8 and 9 are partial cross sectional views which respectively illustrate an essential portion of a third embodiment.
Figure 9:
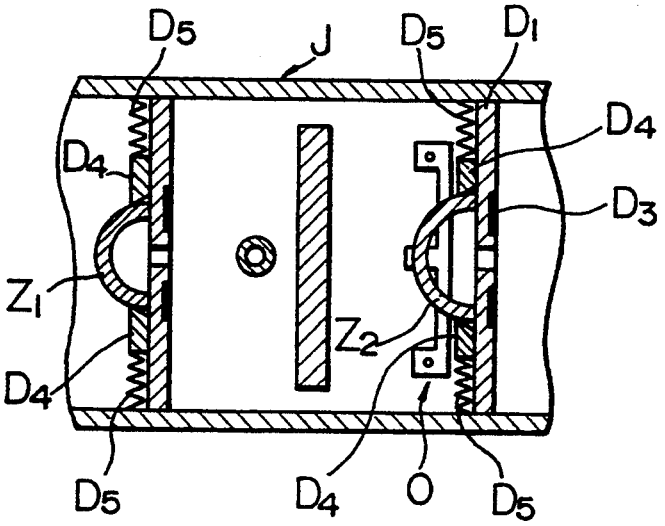

FIGS. 8 and 9 are partial cross sectional views which respectively illustrate essential portions of a third embodiment of the present invention, FIGS. 8 and 9 respectively corresponding to FIGS. 1B and 2B. According to the third embodiment, the rod members $D_2$ and $F_2$ shown in FIGS. 1A and 1B are replaced by a half sliding bearing holding device. The other structures are the same as those according to the first embodiment or the second embodiment. The half sliding bearing holding device according to this embodiment comprises an elongated member $D_4$ or $F_7$ positioned adjacent to the two end portions of the half sliding bearing. Furthermore, the half sliding bearing holding device comprises a spring member $D_5$ or $F_8$ for urging the elongated member $D_4$ or $F_7$ to the two end portions of the half sliding bearing. The half sliding bearing holding device thus arranged acts to overcome the problem which will take place on the backside of the half sliding bearing when the half sliding bearing is moved in the surface-treatment solution. In particular, it can exhibit a significant effect when the half sliding bearing is applied with a surface treatment except for the Ni-plating, for example, the Pb alloy plating.

According to the present invention, the following significant effects can be obtained:

(1) According to the surface treatment apparatus according to the present invention, the half sliding bearings to be applied with the plating are successively introduced into the plating apparatus. Therefore, only the leading portion of the half sliding bearings, which are being successively introduced into the tank, becomes as the defective products, the number of the leading portion of the half sliding bearings corresponding to the half sliding bearings which can be accommodated in the bath at the initial stage of the operation. Then, the half sliding bearings can be successively introduced into the tank while expecting that they will become the products. According to the conventional technology for holding the case, the spacer must be provided for each of the cases. Therefore, the number of the half sliding bearings or the spacers is not increased even if the manufacturing operation is continued all day long. Furthermore, the bearings having the same inner and outer diameters can completely continuously be subjected to the plating operation.

(2) Since the plating jig can be omitted from the structure and only the half sliding bearings are moved, the undesirable drawing of the plating solution can be restricted to that adhered to the half sliding bearing. Furthermore, since the half sliding bearings are independently drawn out from the tank, the conventional problem taken place in that the solution placed between the plating jigs is undesirably drawn out can be prevented. Therefore, the efficiency in washing the half sliding bearings with water can be significantly improved.

(3) The size of the plating apparatus and the wastewater disposal device can be significantly reduced, that is, the overall size of the apparatus can be reduced. Therefore, an arrangement directly connected to the mechanical working line can be realized. Therefore, an unmanned and automatic operation can be performed. It leads to a fact that goods in process can be reduced and a planned production can be realize.

(4) Since all of the half sliding bearings are arranged to pass through the same apparatus, the plating quality in terms of the thickness of the plating layer, the roughness, the adhesive force and composition and the like can be stably uniformed.

(5) Since the number of the anodes can be reduced to one for a tank and the stirring means can also be reduced to one for one plating tank, the adjustment and the control operations can significantly easily be performed.

(6) Since the distance between the cathode (the half sliding bearing) and the anode can be shortened and precisely maintained, a high speed plating operation can be realized. Furthermore, since the quantity of the solution can be reduced, the thickness of the plating can be adjusted at the upper portion and the lower portion of the enclosed solution. Therefore, an apparatus which can significantly easily be used can be provided.

As described above, the problems experienced with the conventional structure can perfectly be overcome.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An apparatus for surface treating a half sliding bearing comprising:

a tank for accommodating a surface-treatment solution;

a surface layer forming device including a slide plate device disposed in said tank and acting for movably arranging a plurality of said half sliding bearings while maintaining a state of contact of said plurality of half sliding bearings and a power supply device which comes in electrical contact with said half sliding bearings of said plurality of half sliding bearings disposed outside said surface-treatment solution, and wherein said slide plate comprises magnetic means for movably holding one or more half slide bearings in a contact state;

a surface-treatment solution stirring pipe disposed away from said surface layer forming device and an elongated through hole formed at a position confronting said surface treatment solution stirring pipe; and an electrode disposed away from said surface-treatment liquid stirring pipe.

2. An apparatus for surface treating a half sliding bearing according to claim 1, wherein said slide plate device is positioned away from said surface-treatment solution stirring pipe by a distance of 10 mm to 50 mm and said stirring pipe is positioned apart from said anode by a distance of 10 mm to 50 mm.

3. An apparatus for surface treating a half sliding bearing according to claim 1 further comprising:

a half sliding bearing introduction device for successively and one by one moving said half sliding bearings to a position above said tank;

a half sliding bearing dipping device for placing said half sliding bearing positioned above said tank to the lower portion of said tank while dipping said half sliding bearing in said surface-treatment solution;

a horizontal conveyance device for placing said half sliding bearing positioned in the lower portion of said tank to a position at the lower end portion of said surface layer forming device; and a lifting and conveyance device for lifting said half sliding bearing, which has been conveyed to said position above said surface-treatment solution after it has been applied with said surface treatment, outside said tank so as to move it.

4. An apparatus for surface treating a half sliding bearing according to claim 1 further comprising:

a half sliding bearing introduction device for successively and one by one placing said half sliding bearings above said tank and as well as above said power supply device;

a horizontal conveyance device for conveying said half sliding bearing which has been applied with said surface treatment by said surface layer forming device and conveyed to the lower portion of said tank to a position away from said surface layer forming device;

a half sliding bearing lifting device for moving said half sliding bearing which has been conveyed by said horizontal conveyance device to a position above said tank; and a lifting and conveyance device for conveying said half sliding bearing which has been conveyed to said position above said tank to a position outside said tank.

5. An apparatus for surface treating a half sliding bearing according to claim 3, wherein said half sliding bearing dipping device or said half sliding bearing lifting device includes a plate member having an embedded magnet which comes in contact with said half sliding bearing and which movably holds said half sliding bearing.

6. An apparatus for surface treating a half sliding bearing according to claim 3, wherein said half sliding bearing dipping device, said surface layer forming device or said half sliding bearing lifting device includes a plate member having an embedded magnet which comes in contact with said half sliding bearing and which movably holds the same and a rod member disposed away from said plate member by a predetermined distance and arranged to perform an assist role to hold said half sliding bearing.

7. An apparatus for surface treating a half sliding bearing according to claim 3, wherein said half sliding bearing dipping device, said surface layer forming device or said half sliding bearing lifting device includes:

a plate member having an embedded magnet which comes in contact with said half sliding bearing and which movably holds the same;

a rod member disposed away from said plate member by a predetermined distance and arranged to perform an assist role to hold said half sliding bearing;

an elongated member positioned adjacent to the two end portions of said bearing: and a spring member for urging said elongated member toward said half sliding bearing.

8. An apparatus for surface treating a half sliding bearing according to claim 3, wherein said horizontal conveyance device includes a pusher which comes in contact with said half sliding bearing, a wire or a belt for moving said pusher, a piston cylinder device for moving said wire or said belt and a holding plate member for movable holding said half sliding bearing.

9. An apparatus for surface treating a half sliding bearing according to claim 3, wherein said horizontal conveyance device includes:

a rod having an upper portion which is connected to said piston cylinder device and a lower portion which comes in contact with said half sliding bearing; and a support shaft which rotatably supports said rod at an intermediate position of said rod; and a holding plate member for movably holding said half sliding bearing.

10. An apparatus for surface treating a half sliding bearing according to claim 3, wherein at least a portion of said tank, said half sliding bearing introduction device, said half sliding bearing dipping device, said half sliding bearing horizontal conveyance device, said surface layer forming device, said surface-treatment solution stirring pipe and said lifting and conveyance device which comes in contact with said surface-treatment solution or with said half sliding bearing is made of an insulating material such as ceramics, glass and hard plastic.

11. An apparatus for surface treating a half sliding bearing according to claim 4, wherein said half sliding bearing dipping device or said half sliding bearing lifting device includes a plate member having an embedded magnet which comes in contact with said half sliding bearing and which movably holds said half sliding bearing.

12. An apparatus for surface treating a half sliding bearing according to claim 4, wherein said half sliding bearing dipping device, said surface layer forming device or said half sliding bearing lifting device includes a plate member having an embedded magnet which comes in contact with said half sliding bearing and which movably holds the same and a rod member disposed away from said plate member by a predetermined distance and arranged to perform an assist role to hold said half sliding bearing.

13. An apparatus for surface treating a half sliding bearing according to claim 4, wherein said half sliding bearing dipping device, said surface layer forming device or said half sliding bearing lifting device includes:

a plate member having an embedded magnet which comes in contact with said half sliding bearing and which movably holds the same;

a rod member disposed away from said plate member by a predetermined distance and arranged to perform an assist role to hold said half sliding bearing;

an elongated member positioned adjacent to the two end portions of said bearing: and a spring member for urging said elongated member toward said half sliding bearing.

14. An apparatus for surface treating a half sliding bearing according to claim 4, wherein said horizontal conveyance device includes a pusher which comes in contact with said half sliding bearing, a wire or a belt for moving said pusher, a piston cylinder device for moving said wire or said belt and a holding plate member for movably holding said half sliding bearing.

15. An apparatus for surface treating a half sliding bearing according to claim 4, wherein said horizontal conveyance device includes:

a rod having an upper portion which is connected to said piston cylinder device and a lower portion which comes in contact with said half sliding bearing; and a support shaft which rotatably supports said rod at an intermediate position of said rod; and a holding plate member for movably holding said half sliding bearing.

16. An apparatus for surface treating a half sliding bearing according to claim 4, wherein at least a portion of said tank, said half sliding bearing introduction device, said half sliding bearing dipping device, said half sliding bearing horizontal conveyance device, said surface layer forming device, said surface-treatment solution stirring pipe and said lifting and conveyance device which comes in contact with said surface-treatment solution or with said half sliding bearing is made of an insulating material such as ceramics, glass and hard plastic.

17. An apparatus for surface treating a half sliding bearing according to claim 5, wherein at least a portion of said tank, said half sliding bearing introduction device, said half sliding bearing dipping device, said half sliding bearing horizontal conveyance device, said surface layer forming device, said surface-treatment solution stirring pipe and said lifting and conveyance device which comes in contact with said surface-treatment solution or with said half sliding bearing is made of an insulating material such as ceramics, glass and hard plastic.

18. An apparatus for surface treating a half sliding bearing according to claim 6, wherein at least a portion of said tank, said half sliding bearing introduction device, said half sliding bearing dipping device, said half sliding bearing horizontal conveyance device, said surface layer forming device, said surface-treatment solution stirring pipe and said lifting and conveyance device which comes in contact with said surface-treatment solution or with said half sliding bearing is made of an insulating material such as ceramics, glass and hard plastic.

19. An apparatus for surface treating a half sliding bearing according to claim 7, wherein at least a portion of said tank, said half sliding bearing introduction device, said half sliding bearing dipping device, said half sliding bearing horizontal conveyance device, said surface layer forming device, said surface-treatment solution stirring pipe and said lifting and conveyance device which comes in contact with said surface-treatment solution or with said half sliding bearing is made of an insulating material such as ceramics, glass and hard plastic.

* * * * *